US005163763A

United States Patent [19]

Weeks et al.

[11] Patent Number: 5,163,763

[45] Date of Patent: Nov. 17, 1992

[54] DOT MATRIX PRINT HEAD ARMATURE

[75] Inventors: David E. Weeks, Candor; Robert L. Wirth, Ithaca, both of N.Y.

[73] Assignee: NCR Corporation, Dayton, Ohio

[21] Appl. No.: 656,319

[22] Filed: Feb. 19, 1991

[51] Int. Cl.[5] ..... B41J 2/26

[52] U.S. Cl. ..... 400/124; 101/93.05

[58] Field of Search ..... 400/124; 101/93.05

[56] References Cited

U.S. PATENT DOCUMENTS

| | | | |
|---|---|---|---|
| 4,236,836 | 12/1980 | Hodne | 400/124 |
| 4,302,114 | 11/1981 | Mielke | 400/124 |
| 4,403,875 | 9/1983 | Asano et al. | 400/124 |
| 4,513,496 | 4/1985 | Wang | 29/606 |
| 4,531,848 | 7/1985 | Sanders et al. | 400/124 |
| 4,537,520 | 8/1985 | Ochiai et al. | 400/124 |
| 4,552,064 | 11/1985 | Sanders et al. | 400/124 |
| 4,653,943 | 3/1987 | Sakaida et al. | 400/124 |
| 4,886,382 | 12/1989 | Oota et al. | 400/124 |
| 4,962,876 | 10/1990 | Andou et al. | 228/193 |
| 5,046,871 | 9/1991 | Saitou et al. | 400/124 |

*Primary Examiner*—David A. Wiecking
*Assistant Examiner*—John S. Hilten
*Attorney, Agent, or Firm*—Albert L. Sessler, Jr.

[57] ABSTRACT

An impact printing apparatus includes an armature and print wire assembly in which a plastic arm is injection molded to interact with recesses in an armature and to surround a portion of a print wire to provide a rigid interconnection between the armature and the print wire.

1 Claim, 3 Drawing Sheets

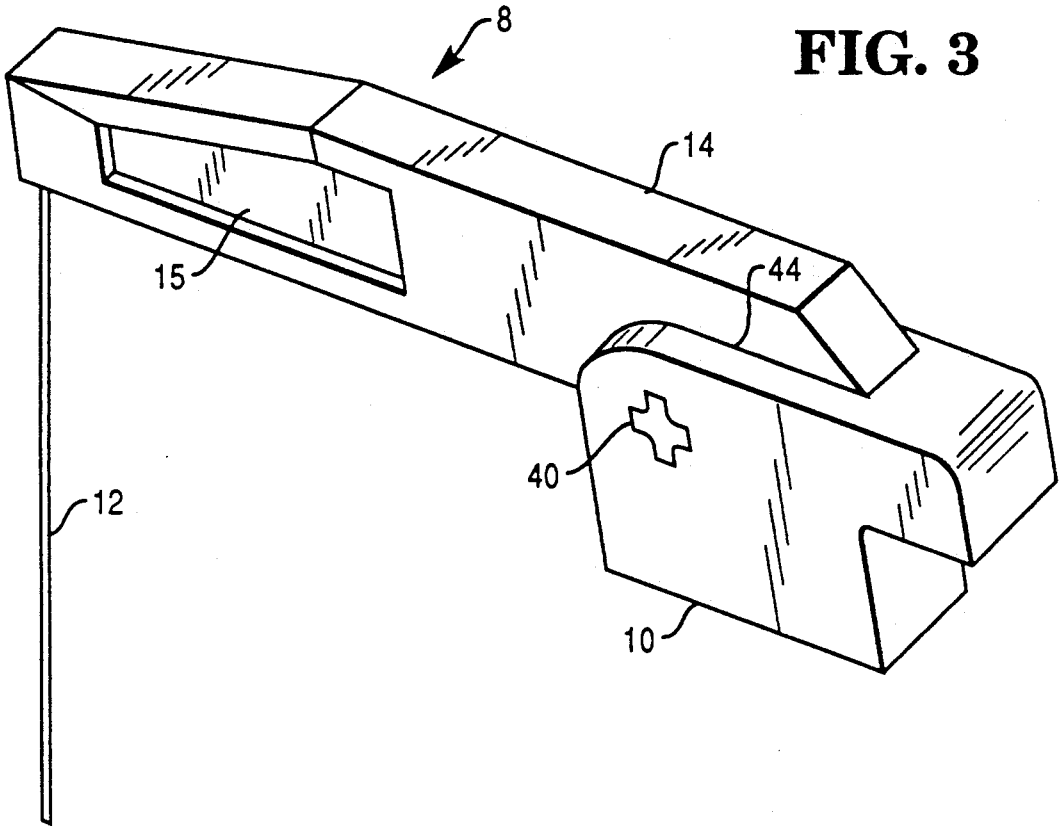
FIG. 3
FIG. 4
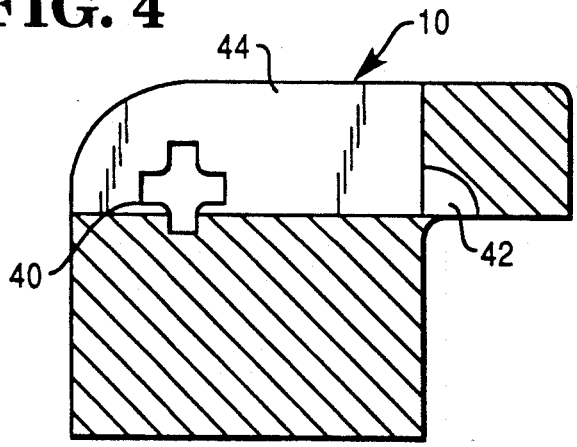

DOT MATRIX PRINT HEAD ARMATURE

BACKGROUND OF THE INVENTION

The present invention relates to printing apparatus, and more particularly relates to a printer of the dot matrix type.

Dot matrix type printers are widely used in various types of data processing and other systems, including retail point of sale terminals, financial terminals and other devices. These printers are versatile in being able to print a wide variety of type fonts and other characters and symbols, and are relatively low in cost in comparison with other types of printers, such as laser printers. Simplicity and reliability of operation are thus important.

SUMMARY OF THE INVENTION

The present invention provides an armature and print wire assembly used in a dot matrix printer.

In accordance with a first embodiment of the invention, a printing apparatus comprises: a movable print wire for effecting printing on a record member, said print wire having a first elongated straight portion, a second shorter straight portion and a curved portion connecting the two straight portions in approximately a right-angle relationship; guide means for guiding the first portion of the print wire; magnetic means capable of being energized for causing said first portion of said print wire to move in an axial direction to cause printing to take place; armature means positioned in operative relation to said magnetic means for movement to an activated position in response to energization of said magnetic means, said armature means having at least one recessed portion therein; and arm means of plastic material for interconnecting said armature means and said print wire, said armature means being fixed adjacent to one end of said arm means and said print wire being fixed adjacent to the other end of said arm means, means to increase the strength and rigidity of said arm means, said means to increase the strength and rigidity including said second shorter portion of said print wire being positioned entirely within said arm means and extending a substantial distance from said other end of said arm means toward said armature means, a portion of said arm means filling said at least one recessed portion of said armature means to cause said armature means, said arm means and said print wire to be rigidly attached together.

It is accordingly an object of the present invention to provide a printing apparatus having a magnetic energizing device, a print wire movable in response to energization of the energizing device, an armature coacting with the magnetic energizing device, and a molded arm rigidly connecting the armature and the print wire.

Another object is to provide, in a printer, an armature and print wire assembly which includes a rigid molded arm interconnecting an armature and a print wire.

With these and other objects, which will become apparent from the following description, in view, the invention includes certain novel features of construction and combinations of parts, a preferred form or embodiment of which is hereinafter described with reference to the drawings which accompany and form a part of this specification.

BRIEF DESCRIPTION OF THE DRAWINGS

FIG. 3 is a perspective view similar to FIG. 2, but showing the armature and the arm in assembled relation.

FIG. 4 is a sectional view of the armature, taken along line 4—4 of FIG. 2.

DETAILED DESCRIPTION

Figure 1:
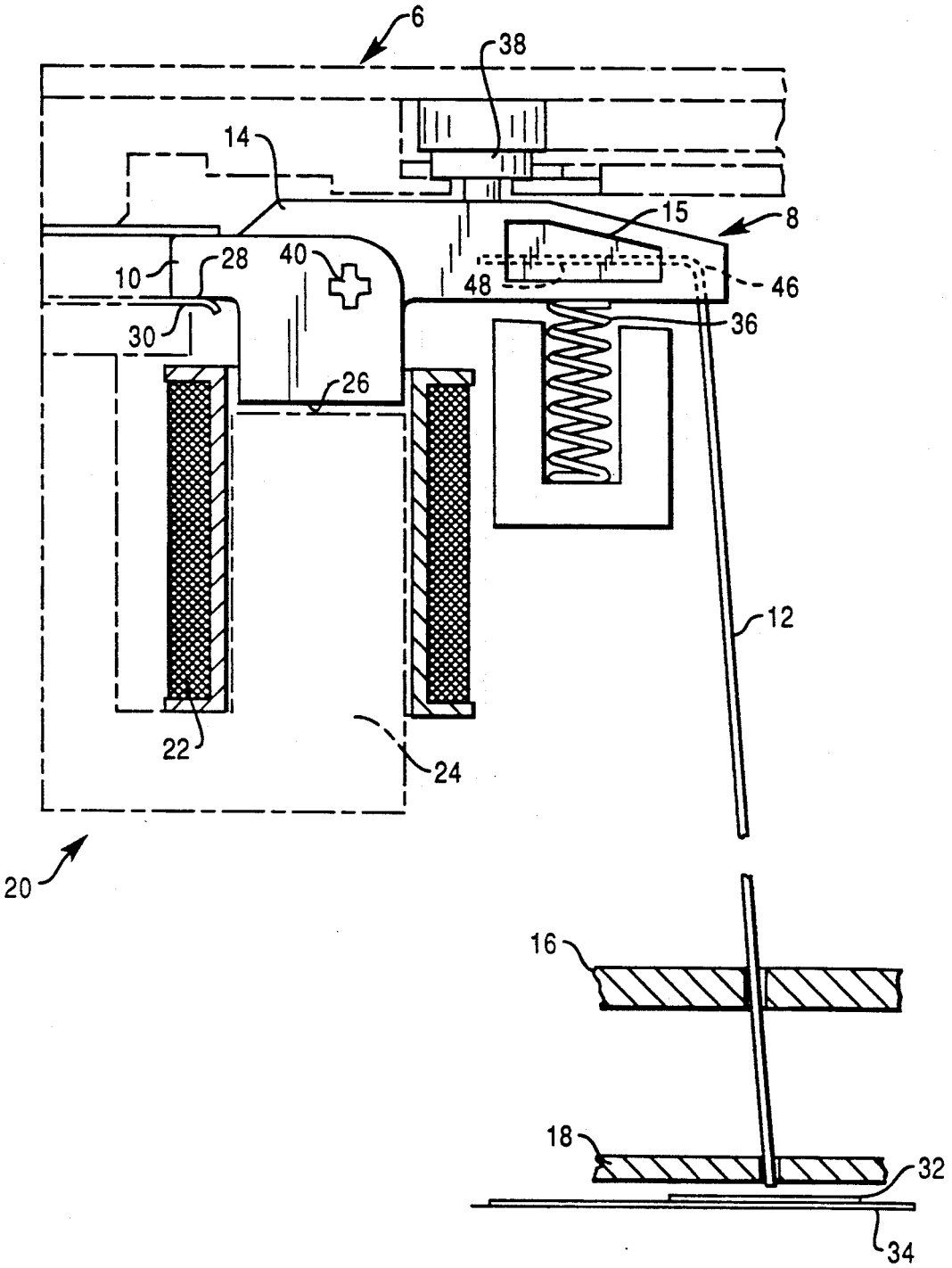
FIG. 1 is a diagrammatic elevational view of a print wire actuator showing certain parts thereof, including a magnetic operating device, an armature cooperable with the magnetic operating device, a print wire and an arm rigidly connecting the armature and the print wire.
Figure 2:
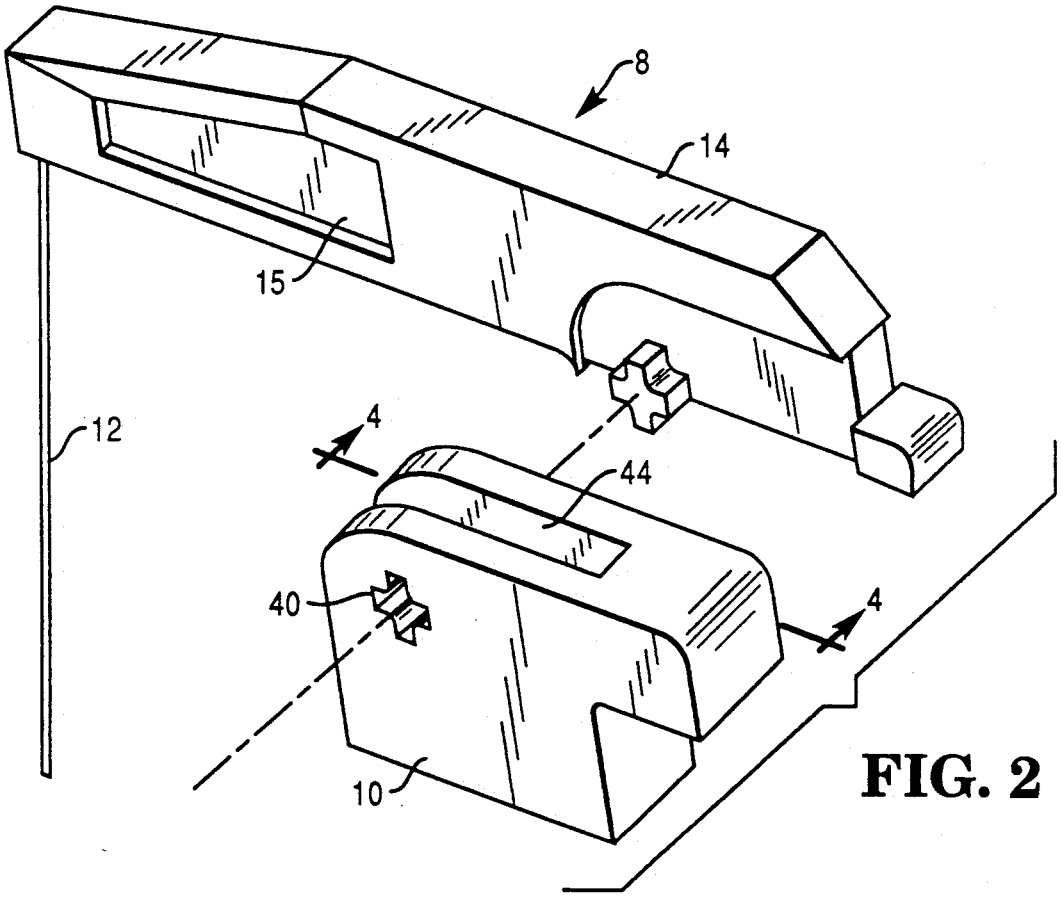
FIG. 2 is a perspective view showing a print wire, an armature and an arm for interconnecting the two, with the arm and the armature being separated to show details of both.

Referring now to FIG. 1, the armature and print wire assembly 8 of the present invention is shown there in proper relationship to the other major parts of the actuator 6. The armature and print wire assembly 8 comprises an armature 10, a print wire 12 and an interconnecting arm 14 (FIGS. 2, 3 and 4), which may be of plastic material and formed by injection molding, and which attaches the print wire 12 rigidly to the armature 10. The plastic arm 14 may have a portion 15 of reduced thickness. The print wire 12 is guided and supported by wire guides 16 and 18. The armature 10 coacts with an electromagnetic energizing device 20, which comprises an electromagnetic coil 22 and a magnetic core 24. In a cycle of operation, the coil 22 is energized, which generates magnetic flux in the working air gap 26. This generates force on the armature 10, causing the armature and print wire assembly 8 to rotate in a clockwise direction about a pivot location 28, on the armature 10, which cooperates with a fulcrum 30 in the actuator 6. The print wire 12 is driven toward an ink ribbon 32 and a record medium 34, to effect printing on said record medium. Parts are dimensioned so that at the time the tip of the print wire 12 contacts and compresses the ribbon 32 and the record medium 34, the air gap 26 is still not completely closed. Therefore the full kinetic energy of the rotating armature and print wire assembly 8 is available for producing a dot on the record medium 34. At this point, the coil 22 is turned off, and the armature and print wire assembly 8 rebounds from the record medium 34 and returns to the home position. A return spring 36 assists in the return motion and the subsequent settling out of the assembly 8 against a backstop damper 38.

The armature and print wire assembly 8 is made by an insert molding operation in which the metal armature 10 and the metal print wire 12 are placed in the cavity of a mold (not shown). The mold is then closed and molten plastic is injected to form the arm 14. The armature design incorporates recessed portions 40 and 42, as well as slotted portion 44, that fill with plastic during molding, and lock the armature 10 securely to the plastic arm 14 after the plastic has solidified. The print wire 12 is designed with a bend 46 and a straight portion 48 that extends along and inside the arm 14 toward the armature 10. This portion adds to the strength and rigidity of the plastic arm 14 and securely locks the print wire 12 to the arm 14. It also provides a place to hold and locate the print wire 12 in proper position in the mold cavity during injection of the molten plastic. After the injected plastic material has hardened, the mold is opened and the armature and print wire assembly 8 is removed.

Assemblies have been molded using a carbon fiber filled nylon 6/6 material which has mechanical properties advantageous for this application; i.e. high modulus of elasticity, high strength, and good temperature and fatigue capability. The armature 10 has been made from 3 percent silicon iron by a metal injection molding process. This process can provide the intricate slots and recesses required by this part.

The advantages of this armature and print wire design are (1) a low cost means of attaching the print wire 12 to the armature 10, and (2) an assembly with a low mass moment of inertia about the pivot. Other methods of construction such as using a stamped steel arm require brazing the print wire to the arm and either brazing or riveting the armature to the arm. This is estimated to be a more costly process than the insert molding operation. Also the required rigidity and strength can be attained with a plastic arm design which has a lower mass moment of inertia than an assembly utilizing a steel arm. Minimizing the mass moment of inertia of the armature and print wire assembly minimizes the response time of the actuator. This is desirable in the design of a printhead actuator 6 which must operate at a high repetition rate. Actuators employing the armature and print wire assembly described in this disclosure have been found to operate well at frequencies in excess of 1800 hertz.

While the form of the invention shown and described herein is admirably adapted to fulfill the objects primarily stated, it is to be understood that it is not intended to confine the invention to the form or embodiment disclosed herein, for it is susceptible of embodiment in various other forms within the scope of the appended claims.

What is claimed is:

1. Printing apparatus comprising:

a movable print wire for effecting printing on a record member, said print wire having a first elongated straight portion, a second shorter straight portion and a curved portion connecting the two straight portions in approximately a right-angle relationship;

guide means for guiding the first portion of the print wire;

magnetic means capable of being energized for causing said first portion of said print wire to move in an axial direction to cause printing to take place;

armature means positioned in operative relation to said magnetic means for movement to an actuated position in response to energization of said magnetic means, said armature means having at least one recessed portion therein; and arm means of plastic material for interconnecting said armature means and said print wire, said armature means being fixed adjacent to one end of said arm means and said print wire being fixed adjacent to the other end of said arm means, means to increase the strength and rigidity of said arm means, said means to increase the strength and rigidity including said shorter portion of said print wire being positioned entirely within said arm means and extending a substantial distance from said other end of said arm means toward said armature means, a portion of said arm means filling said at least one recessed portion of said armature means to cause said armature means, said arm means and said print wire to be rigidly attached together.

* * * * *